US007048506B2

(12) United States Patent
Atmur et al.

(10) Patent No.: US 7,048,506 B2
(45) **Date of Patent: *May 23, 2006**

(54) METHOD AND APPARATUS FOR MAGNETIC ACTUATION OF VARIABLE PITCH IMPELLER BLADES

(75) Inventors: Robert J. Atmur, Whittier, CA (US); Bryan J. Sydnor, Long Beach, CA (US)

(73) Assignee: The Boeing Company, Chicago, IL (US)

( * ) Notice: Subject to any disclaimer, the term of this patent is extended or adjusted under 35 U.S.C. 154(b) by 252 days.

This patent is subject to a terminal disclaimer.

(21) Appl. No.: 10/716,912

(22) Filed: Nov. 18, 2003

(65) Prior Publication Data

US 2005/0106956 A1 May 19, 2005

(51) Int. Cl.
*B63H 3/02* (2006.01)

(52) U.S. Cl. ..... 416/30; 416/155; 440/50

(58) Field of Classification Search ..... 416/1, 416/27–30, 25, 47–48, 155, 31, 42
See application file for complete search history.

(56) References Cited

U.S. PATENT DOCUMENTS 4,648,345 A * 3/1987 Wham et al. ..... 114/338
5,028,210 A * 7/1991 Peterson et al. ..... 416/164
5,291,194 A 3/1994 Ames
5,646,366 A 7/1997 O'Connell
5,748,102 A 5/1998 Barron
6,331,759 B1 12/2001 Atmur
6,332,818 B1 * 12/2001 Duncan et al. ..... 440/66
6,476,534 B1 * 11/2002 Vanderbeck et al. ..... 310/261
6,482,054 B1 11/2002 Treaster et al.
6,536,365 B1 3/2003 Horton
6,600,695 B1 7/2003 Nugent et al.
6,642,683 B1 11/2003 Atmur
6,926,566 B1 * 8/2005 Atmur ..... 440/38
2003/0001538 A1 1/2003 Atmur
2003/0103771 A1 6/2003 Atmur et al.

OTHER PUBLICATIONS

RIM-116A Rolling Airframe Missile (RAM). United States Navy Fact File. [online]. Retrieved from Internet: <URL: www.chinfo.navy.mil/navpalib/factfile/missiles/wep-ram.html>.

Principles of Naval Architecture, Second Revision, Edward V. Lewis Editor, Published by The Society of Naval Architects and Marine Engineers, Jersey City, NJ, Library of Congress Catalog Card No. 88-60829, ISBN No. 0-939773-01-5.

* cited by examiner

*Primary Examiner*—Edward K. Look
*Assistant Examiner*—Nathan Wiehe
(74) *Attorney, Agent, or Firm*—Ingrassia Fisher & Lorenz, P.C.

(57) ABSTRACT

An integrated propulsion and guidance system for a vehicle includes an engine coupled to an impeller via a driveshaft to produce propulsive force. The impeller includes a hub and a plurality of blades, including at least one control blade pivotably mounted to the hub. A control system provides a control signal to a magnetic actuator to adjust the blade pitch of the control blades as the blades rotate about the hub. The change in blade pitch produces a torque on the driveshaft that can be used to control the heading of the vehicle.

15 Claims, 8 Drawing Sheets

METHOD AND APPARATUS FOR MAGNETIC ACTUATION OF VARIABLE PITCH IMPELLER BLADES

TECHNICAL FIELD

The present invention generally relates to vehicle propulsion systems, and more particularly relates to a magnetic actuator for a variable pitch impeller system that simultaneously provides propulsion and guidance to a vehicle.

BACKGROUND

Various types of manned and unmanned undersurface vehicles (UUVs) have been developed in recent years for military, homeland security, underwater exploration and other purposes. These devices typically resemble a torpedo or small submarine, yet are typically capable of sophisticated underwater tasks including reconnaissance, ordnance neutralization, ship repair and the like.

At present, however, the full potential of UUVs is limited by the propulsion and control systems currently available for such devices. For very slow-moving systems, for example, very precise control is typically desired, yet this level of control is not generally available from conventional control fin assemblies. Moreover, conventional fin assemblies typically jut out from the body of the vehicle, and may therefore be susceptible to breakage or deformity when the UUV is deployed in highly-demanding environments (e.g. from the air or a submarine) if the fins are not sufficiently reinforced. Further, fin assemblies tend to be less precise when operating in reverse, thereby limiting the maneuverability of the vehicle, particularly at low speeds. Other problems associated with various conventional fin assemblies include cost, mechanical complexity, excess acoustic noise, control authority and survivability. Although the above concerns are addressed by propelling and steering the vehicle with a variable blade pitch impeller, concerns remain in efficiently actuating the various control blades of such impellers.

Accordingly, it is desirable to create a vehicle control and propulsion system that is able to precisely drive and steer the vehicle. In addition, it is desirable to create a control system and technique that is effective at low speeds, that does not increase fin surface area of the vehicle, that operates effectively in reverse, and that operates without complex linkages at a relatively low cost. Moreover, it is desirable to create efficient actuation systems and techniques for such control and propulsion systems. Furthermore, other desirable features and characteristics of the present invention will become apparent from the subsequent detailed description and the appended claims, taken in conjunction with the accompanying drawings and the foregoing technical field and background.

BRIEF SUMMARY

According to various exemplary embodiments, an integrated propulsion and guidance system for a vehicle includes an engine coupled to an impeller via a driveshaft to produce propulsive force. The impeller includes a hub and a plurality of blades, including at least one control blade pivotably mounted to the hub. A control system provides a control signal to a magnetic actuator to adjust the blade pitch of the control blades as the blades rotate about the hub. The magnetic actuator provides an electromagnetic field that interacts with a magnet coupled to the control blade to adjust the pitch of the control blade. The change in blade pitch produces a torque on the driveshaft that can be used to control the heading of the vehicle. By varying the magnitude and phase of the control signal provided to the impeller, the torque can be applied in a multitude of distinct reference planes, thereby allowing the orientation of the vehicle to be adjusted through action of the impeller. Moreover, because the control blades are actuated magnetically, mechanical linkages between the impeller and the blade control motor may be eliminated.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

According to various exemplary embodiments, a control system and method for a vehicle operating in a fluid medium (e.g. water, air) uses the propulsion element (e.g. impeller or propeller) of the vehicle to produce guidance force as well. By selectively adjusting the pitch angle of propulsion blades as they rotate through the fluid medium, the relative forces and moments produced by the various blades can be manipulated to produce torques on the vehicle driveshaft that can be used to position the vehicle. One or more impeller blades, for example, can be actuated in a sinusoidal or sawtooth manner such that one period of actuation is completed for each revolution of the blade at a pre-determined phase relative to the "heads up" of the vehicle and a magnitude proportional to a desired command. This action produces a force on the blade that is completely determined by the magnitude and phase (R-theta) of the blade motion, and that can be used to orient the vehicle. In a further embodiment, the variable pitch of the blades is selected and controlled through an actuation system that uses magnetic attraction and/or repulsion to pivot the control blades into a desired state.

Although the invention is frequency described herein as applying to pivoting impeller blades on an unmanned undersurface vehicle (UUV), the concepts and structures described herein may be readily adapted to a wide array of equivalent environments. The propulsion and guidance techniques described herein could be used on any type of impeller or propeller-driven aircraft or seacraft, including any type of airplane, surface vessel, underwater vessel, aerial drone, torpedo, missile, or manned or unmanned vehicle, for example.

As used herein, the term "substantially" is intended to encompass the specified ranges or values, as well as any variations due to manufacturing, design, implementation and/or environmental effects, as well as any other equivalent values that are consistent with the concepts and structures set forth herein. Although numerical tolerances for various structures and components will vary widely from embodiment to embodiment, equivalent values will typically include variants on the order of plus or minus fifteen percent or more from those specified herein.

Figure 1A:
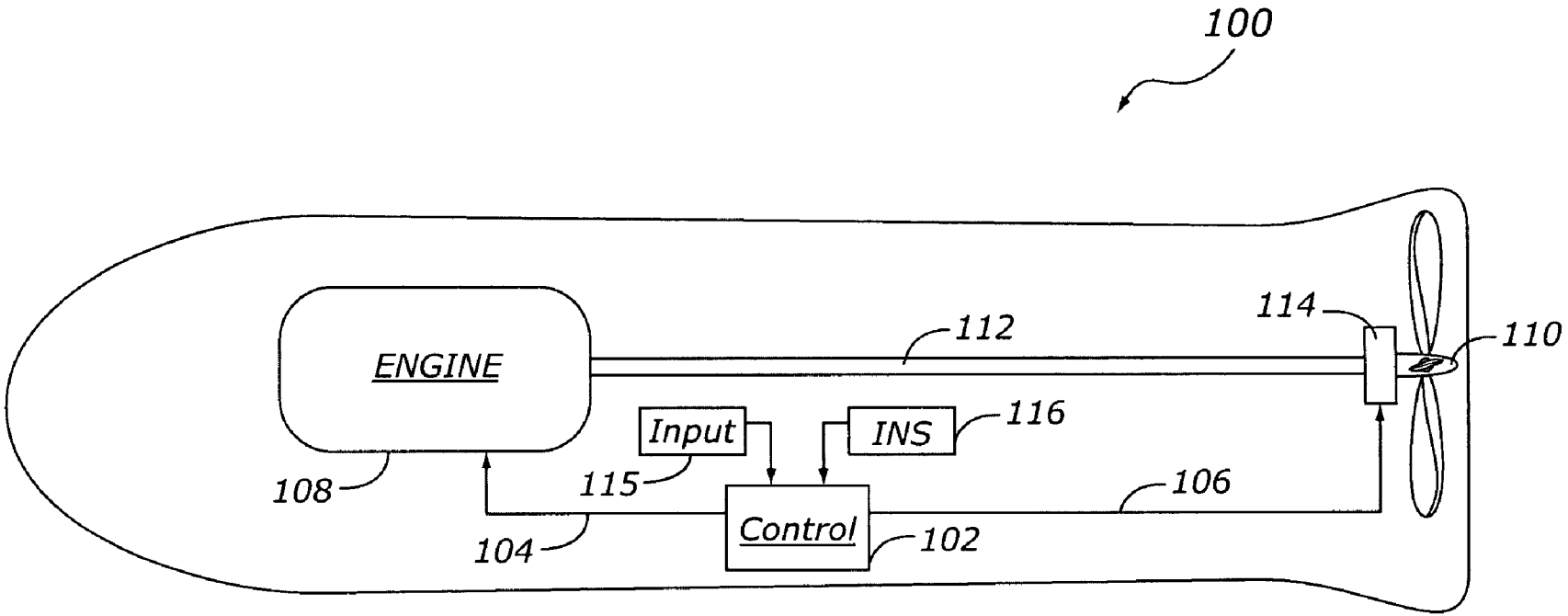
FIGS. 1A and 1B are block diagrams of exemplary vehicles having integrated propulsion and guidance systems.

Turning now to the drawing figures and with initial reference to FIG. 1A, an exemplary vehicle 100 suitably includes an engine 108 providing rotational energy to an impeller 110 via a driveshaft 112. A control motor 114 is used to position one or more blades of impeller 110 as described more fully below. The speed and position of engine 108 and control motor 114 remain synchronized by command signals 104, 106 produced by a controller 102. Signals 104, 106 are further used to control the propulsion and orientation of vehicle 100 as appropriate. In particular, controller 102 supplies a position command 106 to control motor 114 that is relative to engine 108 and/or another point of reference (e.g. the "heads up" orientation of vehicle 100, a vertical or horizontal reference, or the like) to displace the pitch angle of the control blades relative to the fixed impellor blades at the correct locations and times during rotation to produce the torque desired to properly position the vehicle.

Controller 102 is any processor, processing system or other device capable of generating control signals 104, 106 to engine 108 and control motor 114, respectively. In various embodiments, controller 102 is a microcontroller or microprocessor-based system with associated memory and/or mass storage for storing data and instructions executed by the processor. Although a single controller 102 is shown in FIG. 1, alternate embodiments may use two or more separate processors for producing control signals 104 and 106.

Control signals 106, 108 are produced using any appropriate computation or control technique. In an exemplary embodiment, controller 102 receives operator inputs 115 and/or input from an inertial navigation system (INS) 116, gyroscope, global positioning system (GPS) or other device to obtain data about a current and desired state of the vehicle (e.g. position, orientation, velocity, etc.). Controller 102 then creates appropriate control signals 104, 106 using any conventional data processing and/or control techniques presently known or subsequently developed. In various embodiments, control signal 104 provided to engine 108 includes data relating to the direction and/or magnitude of the rotational force applied to propeller 110 by engine 108 via driveshaft 112, which in turn generally corresponds to the direction and magnitude of propulsive force applied to vehicle 100. Similarly, control signal 106 is provided to control motor 114 to produce appropriate variation in the pitch of one or more impeller blades, which in turn produces changes in the heading of vehicle 100, as described more fully below. Control motor 114 may actuate blades on impeller 110 in any appropriate manner, such as though the use of electronic, hydraulic, magnetic, electrostatic, mechanical or any other actuation technique. Signals 104, 106 may be provided in any digital or analog format, including pulse coded modulation (PCM) or the like.

In operation, then, controller 102 suitably generates drive signals 104, 106 as a function of operator inputs 115 and/or inertial or other position data 116. Engine 108 demodulates and/or decodes signal 104 to provide an appropriate rotational force on driveshaft 112, and to thereby rotate impeller 110 in a desired direction. Control motor 114 similarly demodulates and/or decodes signal 106 to provide appropriate control inputs to adjust the blade pitch of impeller 110, which in turn provides appropriate forces and/or moments on shaft 112 or another portion of vehicle 100 to place vehicle 100 into a desired orientation. Accordingly, both vehicle propulsion and guidance is provided by a common impeller 110.

Figure 1B:
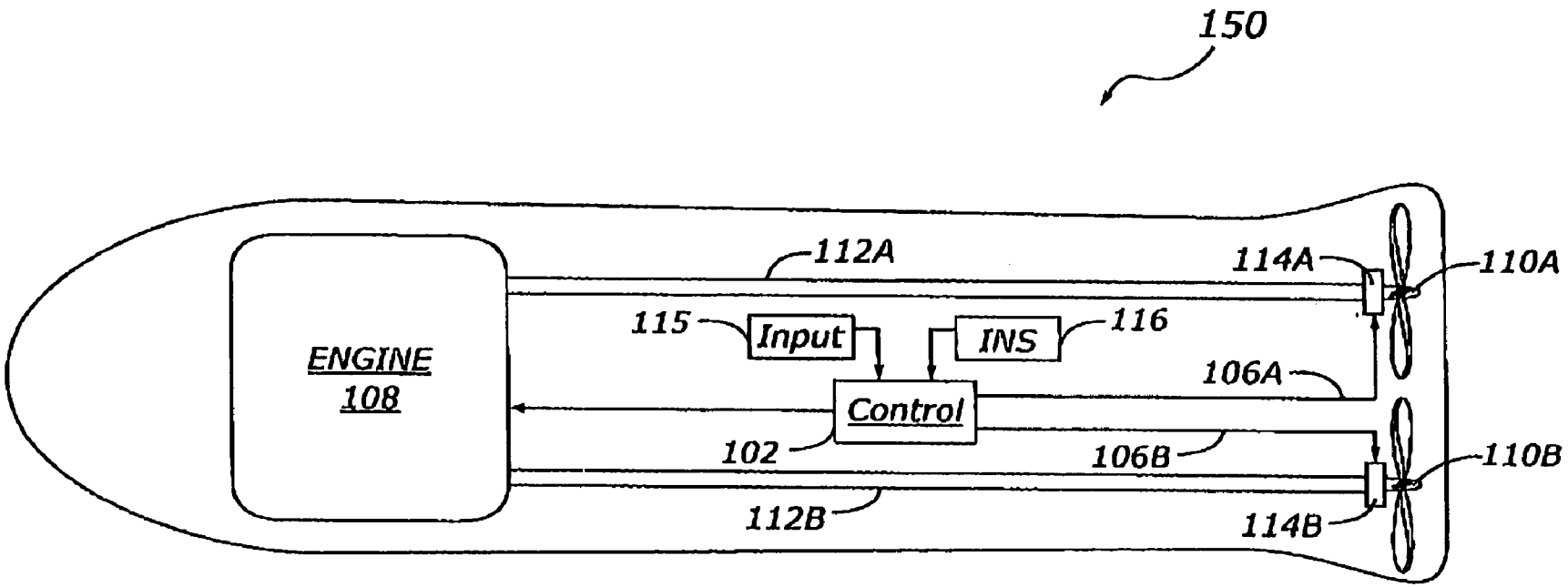

Similar concepts may be applied to vehicles with more than one impeller 110. With reference now to FIG. 1B, an exemplary vehicle 150 with a dual-impeller drive system suitably includes two driveshafts 112A–B coupling rotational energy from engine 108 to a pair of impellers 110A and 110B. Impellers 110A and 110B are typically counter-rotating (i.e. rotating in opposite directions) to reduce noise and turbulence commonly associated with single impeller systems. Each of impellers 110A and 110B suitably include one or more pivotable blades acting in tandem with each other to provide appropriate forces and moments to direct vehicle 150 in response to control signals 106A and 106B, respectively. Such embodiments will typically provide control signals 106A–B to control motors 114A–B (respectively) that are approximately identical, but 180 degrees out of phase for counter-rotating impellers 110A–B due to the different directions of rotation. Alternate but equivalent embodiments may include multiple engines 108 corresponding to each driveshaft 112A–B. Similarly, multiple impellers 110 could be placed on a common driveshaft 112 to produce additional thrust, or counter-rotating impellers 110 could be placed in series (i.e. such that each impeller rotates about a common axis), with driveshaft 112 having an inner portion rotating one of the impellers 110 in a first direction and an outer portion rotating the other impeller 110 in the opposite direction. Accordingly, alternate embodiments of vehicle 100/150 will include any number of impellers 110 arranged in any serial and/or parallel manner and rotating about any number of driveshafts 112.

Figure 2:
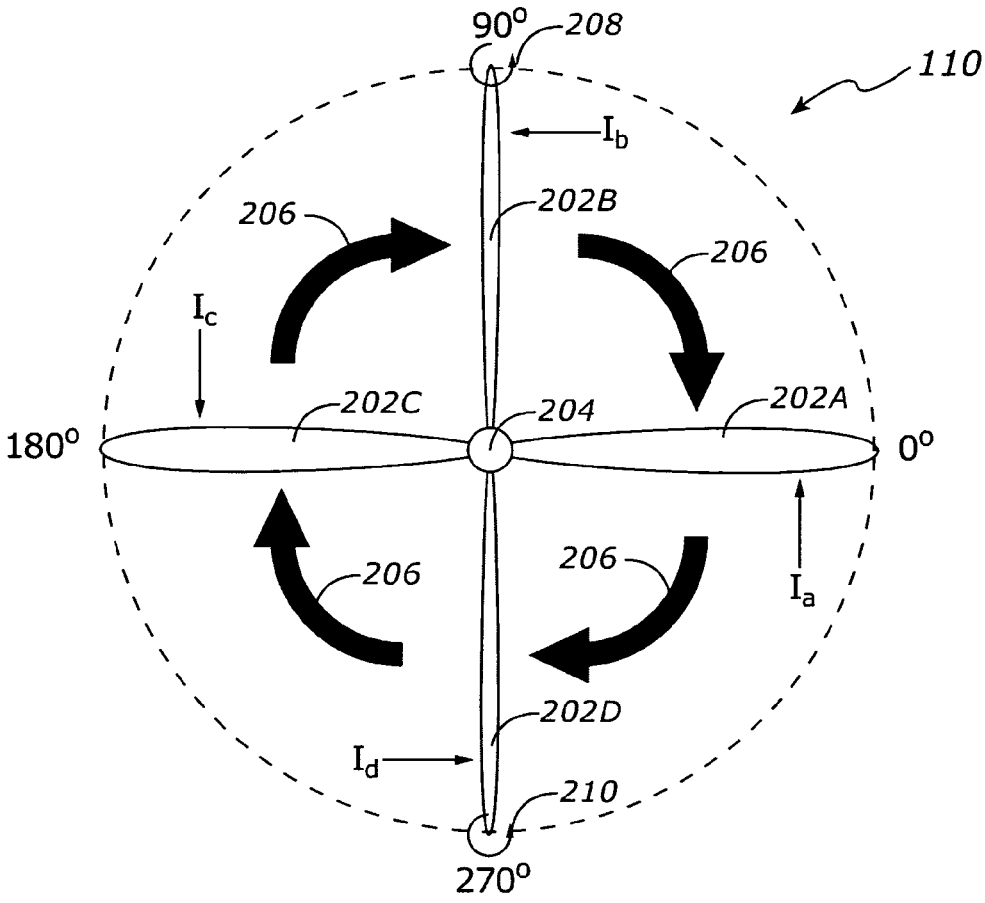
FIG. 2 is a rear view of an exemplary impeller with rotatable blades.

Referring now to FIG. 2, an exemplary impeller 110 suitably includes two or more blades 202A–D rotating about a central hub 204 as appropriate. One or more of blades 202A–D is pivotable with respect to hub 204 to vary the pitch of the blade in response to control signal 106 (FIG. 1). In the exemplary embodiment shown in FIG. 2, two blades 202B, 202D are pivotable about an axis parallel to driveshaft 112 (FIG. 1), although in alternate embodiments any number of blades could be made to be pivotable. In embodiments using an odd number of impeller blades, however, the mathematics used to model and control impeller 110 may be greatly simplified if an odd number (e.g. one or three) of blades 202 are pivotable. Similarly, in embodiments using an even number of impeller blades, control may be easiest when pairs of opposing blades (e.g. blades directly opposite hub 204) are made to be pivotable. Nevertheless, various embodiments could be formulated with any even or odd number of blades (e.g. one to about eight or more), each with any number of pivotable blades in any arrangement Pivotable blades are also referred to herein as "control blades".

As blades 202A–D rotate about hub 204, each blade provides an impedance force (shown as vectors $I_{a-d}$, respectively, in FIG. 2) against the water, air or other fluid medium that creates a moment about hub 204. In a conventional impeller (e.g. as described below in conjunction with FIG. 4), the pitch of each blade 202 with respect to the fluid is relatively constant. The total impedance forces and moments applied in the plane of blades 202 is therefore zero, since the forces opposing rotation are substantially equal on all blades, yet applied in opposing directions such that the forces cancel each other. By adjusting the pitch of one or more blades, however, a force and torque imbalance about hub 204 is created, thereby producing rotation of vehicle 100 in a desired plane.

In the example shown in FIG. 2, as impeller 110 rotates in the direction of arrows 206, the pitch of one or more control blades 202 is adjusted to create additional impedance ($I_b$) at the 90 degree position by rotating the blade in the direction of arrow 208. Similarly, the pitch of one or more control blades 202 is adjusted to create reduced impedance ($I_d$) at the 270 degree position. An increase in impedance may be created by, for example, pivoting blade 202*b* such that the broad face of the blade is more perpendicular to the direction of motion; decreases in impedance may be created by turning the broad face of blade 202*d* to be more parallel to the direction of movement. Because the impedance force is greater at the 90 degree position than at the 270 degree position of impeller 110, the imbalance of force between $I_b$ and $I_d$ produces a moment about hub 204 and/or driveshaft 112 (FIG. 1) that can be used to adjust the orientation of vehicle 100. The pitch of control blades 202*b* and 202*d* therefore changes as the blades rotate about hub 204.

Figure 3:
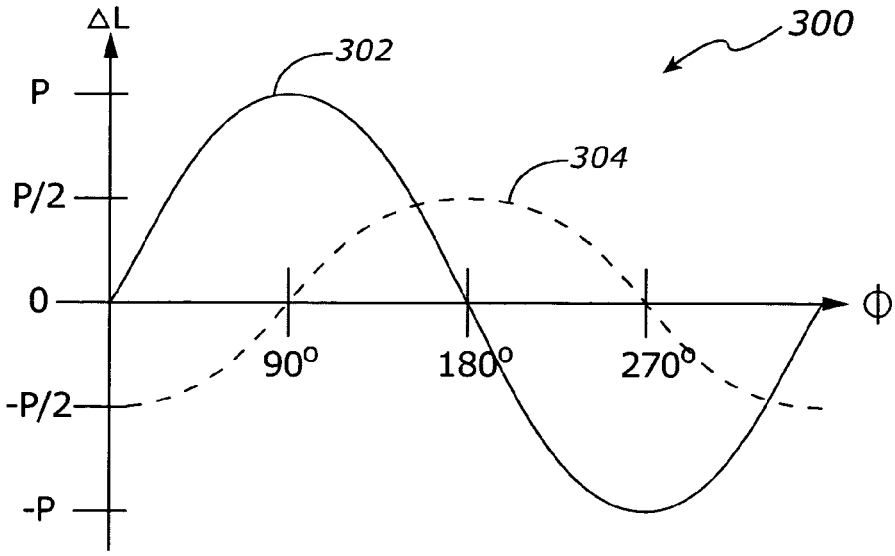
FIG. 3 is a plot of exemplary control signals for the rotatable blades.

FIG. 3 is a plot 300 of several exemplary pitch oscillations 302, 304 that could produce various changes in orientation of vehicle 100. Although waveforms 302, 304 represent blade pitch oscillations rather than actual control signals, these oscillations generally correspond to control signal 106 shown in FIG. 1. Accordingly, control signal 106 may be provided to produce generally sinusoidal oscillations in the control blades, as shown in FIG. 3. Alternatively, blade pitch changes may be more linearly applied such that waveforms on plot 300 take on a sawtooth or triangular shape, as appropriate.

With continued reference to FIG. 3, changes in the phase and magnitude of oscillations 302, 304 can be used to produce different control effects upon vehicle 100. Waveform 302, for example, shows a sinusoidal variation that maximizes deflection (and therefore the impedance) at 90 degree and minimizes the impedance at 270 degrees, as described above in conjunction with FIG. 2. In a vehicle 100 with impeller 110 mounted aft of the center of mass, pivoting in this manner creates a "yaw" moment that steers the craft toward starboard. By inverting waveform 302 such that maximum impedance occurs at 270 degrees and minimum deflection occurs at 90 degrees, a yaw to port motion would be created. The directions of motion set forth in the preceding example will likely be reversed in embodiments wherein impeller 110 is mounted forward of the center of mass of vehicle 100. Similarly, waveform 304 shows blade deflections that would produce an upward pitch ("nose up") effect on vehicle 100.

By varying the location and magnitude of the blade pivot (corresponding to the phase and magnitude of waveforms 302, 304), then, vehicle 100 may be rotated about any desired plane of movement. Pitching and/or yawing movements, for example, may be applied by simply selecting the appropriate radial positions to pivot the control blades. Also, the amount of pivot applied may vary to produce large or small adjustments in vehicle 100. Waveform 302, for example, is shown to have an amplitude that is approximately twice the amplitude of waveform 304. Practical pivot waveforms used in various embodiments may have amplitudes of any magnitude (e.g. from zero to about 25 degrees or more). In an exemplary embodiment, a maximum pitch deflection of about 15 degrees may be used to adequately steer vehicle 100, although this value may vary dramatically in alternate embodiments. Similarly, phase shifts of any amount may be applied to produce torque in any reference plane to provide a desired pitch and/or yaw effect upon vehicle 100.

Figure 4A:
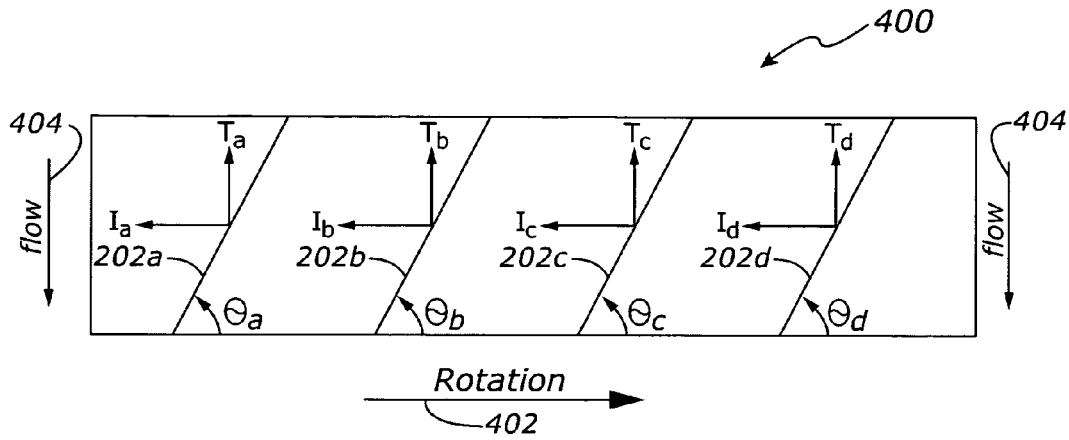
FIGS. 4(*a*) and 4(*b*) are diagrams showing forces applied by an exemplary impeller with uniform and non-uniform blade pitch, respectively.
Figure 4B:
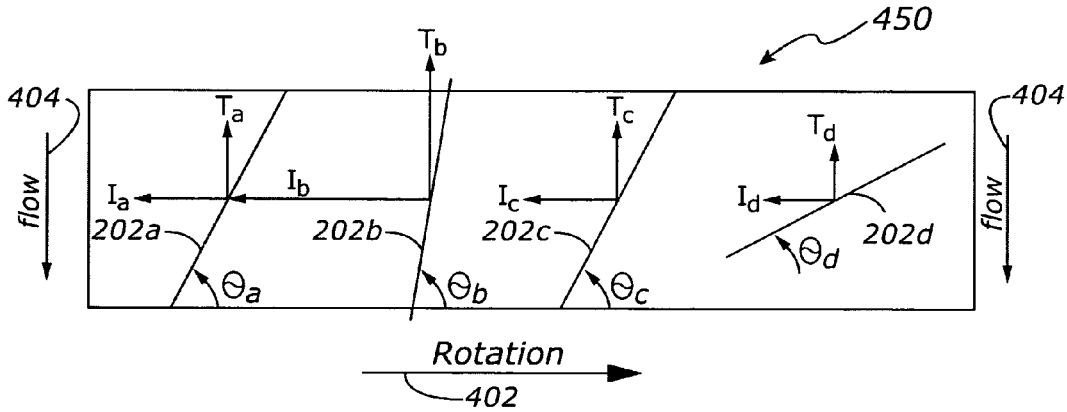
Figure 5:
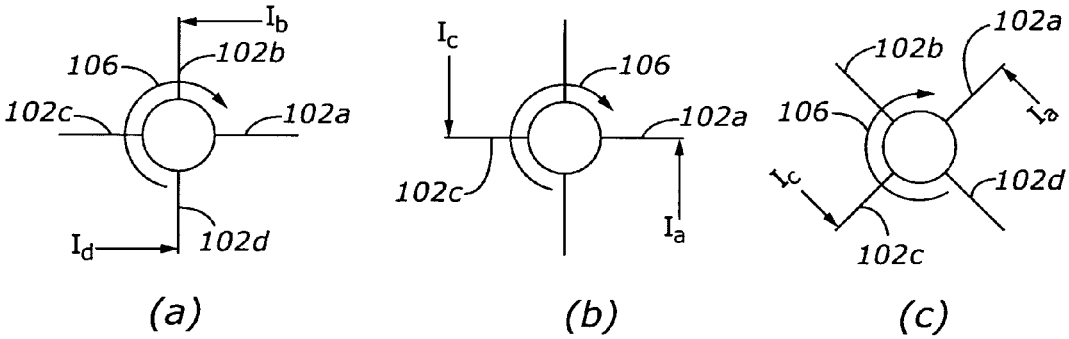
FIGS. 5(*a*)–(*c*) are free body diagrams showing exemplary forces applied to move a vehicle in different planes of movement.

The concepts of force and torque imbalance are further illustrated in FIGS. 4 and 5. FIG. 4 shows the forces applied to the various impeller blades 202A–D when the blade pitch ($\phi$) is substantially equal for all of the blades. FIG. 5 shows the forces applied when control blades 202B and 202D are pivoted to a different pitch than blades 202A and 202C. In each Figure, the direction of impeller rotation is shown by arrow 402, and the direction of fluid flow is shown by arrow 404, although the same concepts described herein will work even if the directions of rotation and/or fluid flow are reversed.

As shown in FIG. 4, the force ($I_a$-$_d$) opposing rotation is equal on all of the impeller blades 202A–D. Because the blades are typically arranged in a regular pattern about hub 204 (FIG. 2), the impedance forces generally cancel each other, thereby resulting in a pure torque resulting from the thrust vectors $T_a$-$_d$ shown. Although the magnitude of the thrust and impedance vectors varies with the pitch of the impeller blades, the amount of thrust and the amount of impedance produced for a particular blade are generally proportional to each other. By properly varying the pitch of various blades 202, then, a torque imbalance may be created without significantly affecting the amount of thrust produced by impeller 110. In the example shown in FIG. 4, for example, blade 202B is rotated to a steeper angle (shown as $\phi_b$) with respect to the direction of rotation than blades 202A and 202C, resulting in a greater impedance vector ($I_b$) and thrust vector ($T_b$). The torque imbalance produced by blade 202B is further increased by decreasing the pitch ($\phi_d$) of blade 202D, which may be located directly opposite hub 204 (FIG. 2) from blade 202B such that the two blades are continuously 180 degrees out of phase with each other. Just as the increased pitch $\phi_b$ resulted in increased impedance and thrust, the decrease pitch $\phi_d$ results in decreased impedance and thrust produced by blade 202D. The decrease in impedance serves to increase the torque imbalance that produces rotation of vehicle 100; the decrease in thrust $T_d$ effectively compensates for the thrust increase produced by blade 202B, thereby maintaining an approximately constant total thrust produced by impeller 110. The total thrust will vary slightly as the blades pivot, since some momentum previously used to produce thrust is now consumed to produce residual rotational moments; nevertheless, the effects of this change in thrust will typically be negligible compared to the total amount of thrust produced by impeller 110.

As briefly discussed above, the unbalance in moments created by pivoting the control blades is translated into a force that is normal to the thrust axis and normal to the plane in which the blades are deflected. By varying the deflection plane, then, a normal force can be provided in any desired direction. FIGS. 5(*a*)–(*c*) show several exemplary impedance forces applied to an impeller 110. As briefly described above, applying maximum deflection at 90 and 270 degrees (FIG. 5(*a*)) typically results in a yaw movement, whereas deflection at 0 and/or 180 degrees typically results in a pitching movement (FIG. 5(*b*)) of vehicle 100. FIG. 5(*c*) demonstrates that pitching and yawing moments may be simultaneously provided by applying maximum deflection at other rotational positions of impeller 110.

The general concepts of steering a vehicle 110 using variations in impeller blade pitch may be implemented in any manner across a wide array of alternate environments having one, two or any other number of impellers. Different types of impellers and/or propellers may be actuated/deflected using hydraulic or other mechanical structures, for example, or using any type of electronic control. In a further embodiment, a magnetic actuation scheme may be used to further improve the efficiency and performance of the vehicle control system. An example of a magnetic actuation scheme is described below in conjunction with FIGS. 6–9.

Figure 6:
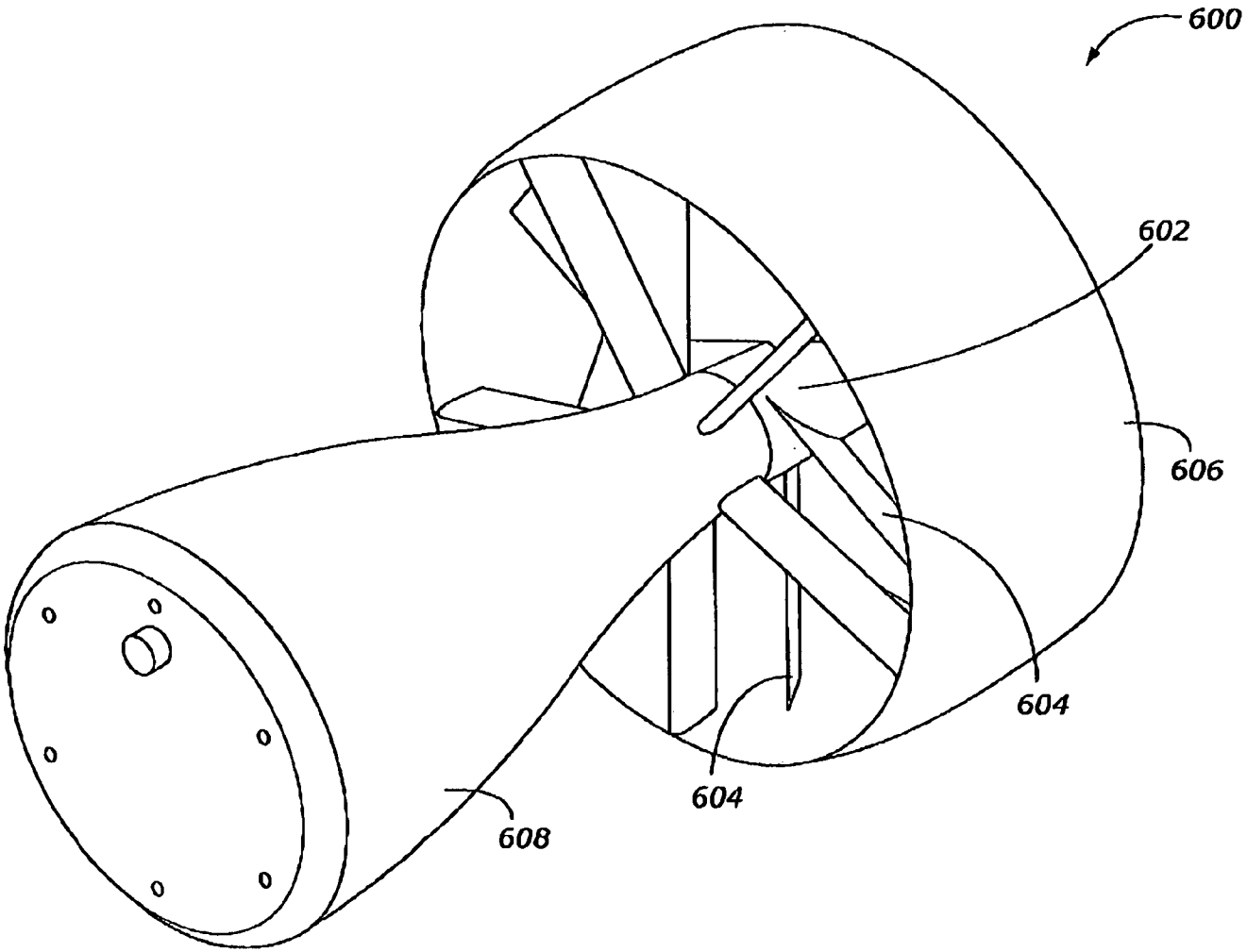
FIG. 6 is a perspective view of an exemplary impeller assembly.

With reference now to FIG. 6, an exemplary impeller assembly 600 suitably includes an impeller 602 having two or more blades 604 that are housed within a shroud 606. Engine 108 and driveshaft 112 (FIG. 1) are appropriately contained within a housing 608 that also provides a suitable hydrodynamic surface. The entire assembly 600 may be bolted, welded, integrally formed or otherwise coupled to the fore or aft portion of vehicle 100 (FIG. 1) as appropriate. Impeller 602, shroud 606 and housing 608 may be formed of any suitable material such as metal (e.g. steel, aluminum, titanium), plastic, fiberglass, composite material or the like.

Figure 7:
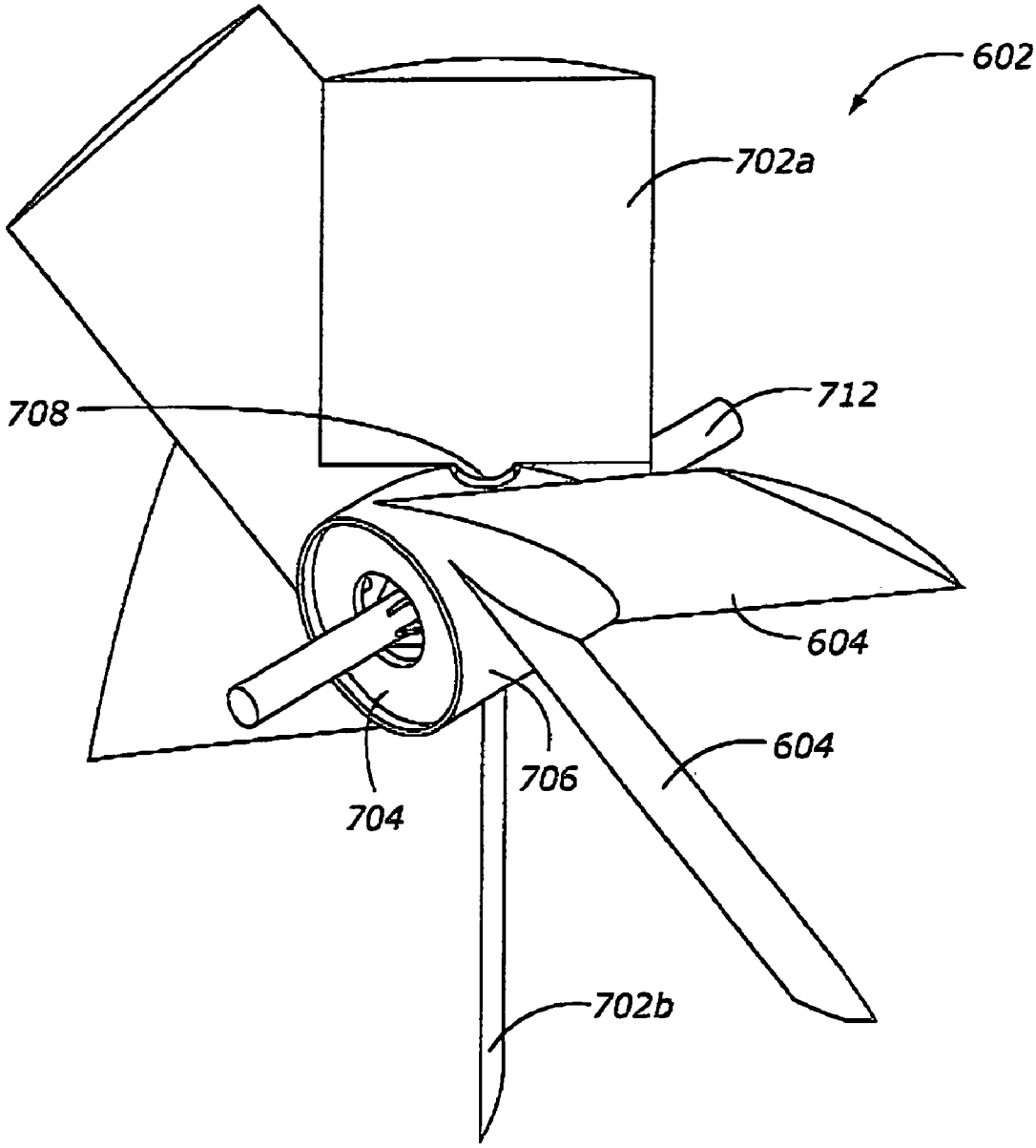
FIG. 7 is a perspective view of an exemplary impeller.

Referring now to FIG. 7, an exemplary impeller 602 suitably includes any number of blades 604 (e.g. six blades arranged in three pairs are shown in FIG. 7) rotating about a central hub 706 that is coupled to receive rotational energy from a driveshaft 712. In the exemplary impeller 602 shown in FIG. 7, blades 702*a*–*b* are pivotable control blades and the other four blades (shown as blades 604) are rigidly fixed with respect to hub 706. Fixed blades 604 may be bolted, welded, integrally formed or otherwise rigidly fixed to hub 706 in any manner. Control blades 702*a*–*b* are appropriately joined to a moveable magnet assembly 704 that is linearly moveable within hub 706 to actuate (pivot) the control blades. The control blades themselves pivot upon bearings 708 mounted to hub 706.

Figure 8:
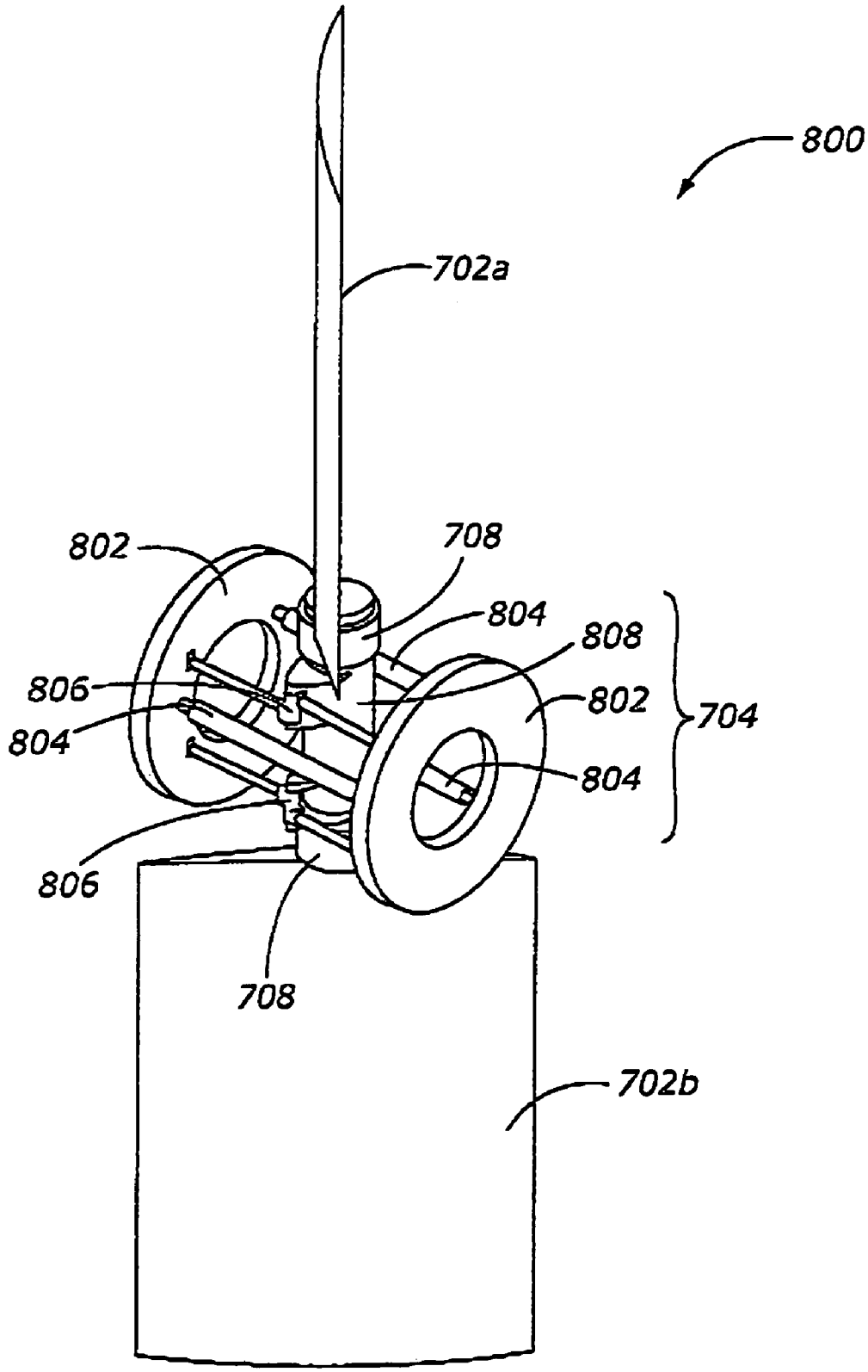
FIG. 8 is a perspective view of an exemplary propeller blade assembly for providing variable blade pitch.

Additional detail about the control blade assembly 800 is shown in FIG. 8. With reference now to FIG. 8, magnet assembly 704 suitably includes one or more magnets 802 rigidly fixed with respect to each other and separated by one or more journal bearings 804. Journal bearings 804 suitably keep magnets 802 moving in a linear fashion within hub 706 (FIG. 7) with respect to each other as appropriate. Magnets 802 are any permanent or other magnets capable of maintaining a magnetic polarization for a period of time sufficient to actuate blades 702*a*–*b*. In an exemplary embodiment, magnets 802 are permanent magnets such as alnico (Aluminum-Nickel-Cobalt), ceramic (e.g. strontium or barium ferrite) or rare-earth (e.g. Nd—Fe—B) magnets.

Blades 702*a*–*b* are appropriately coupled to each other via shaft 808 so that the two blades pivot together. Radial bearings 708 support shaft 808 in place within hub 706 (FIG. 7) and support the pivot movement of blades 702*a*–*b*. Blades 702*a*–*b* are fixed to magnet assembly 704 through one or more arms 806. Arms 806 suitably include a hinge or other joint such that lateral movement of magnet assembly 704 allows shaft 808 to pivot within bearings 708 to thereby change the effective pitch of blades 702*a*–*b*.

Through the application of an appropriate attractive and/or repulsive electromagnetic force from a non-rotating stator (e.g. an electromagnet as described below), magnets 802 can be displaced in an axial direction within hub 706 (FIG. 7). Further, the construction of the rotating blade assembly 800 allows for a substantially constant magnetic flux density across magnets 802 regardless of the radial position of assembly 800; that is, a constant axial force within hub 706 is provided as blade assembly 800 rotates with impeller 602. Axial movement by magnets 802 is translated into rotational movement of shaft 808 within bearings 708 through a cam-type arrangement between shaft 808 and arm 806. By varying the timing and magnitude of the applied electromagnetic flux, then, the phase and magnitude of the blade pitch can be adjusted as desired. Accordingly, the blade pitch can typically be controlled with a relatively simple linear control with a bandwidth on the order of 10 Hertz or less, although other embodiments may use any type of control system having any bandwidth. Further, no mechanical linkage is required between the control motor 114 (FIG. 1) and blade assembly 800 to provide for variable blade pitch.

Figure 9:
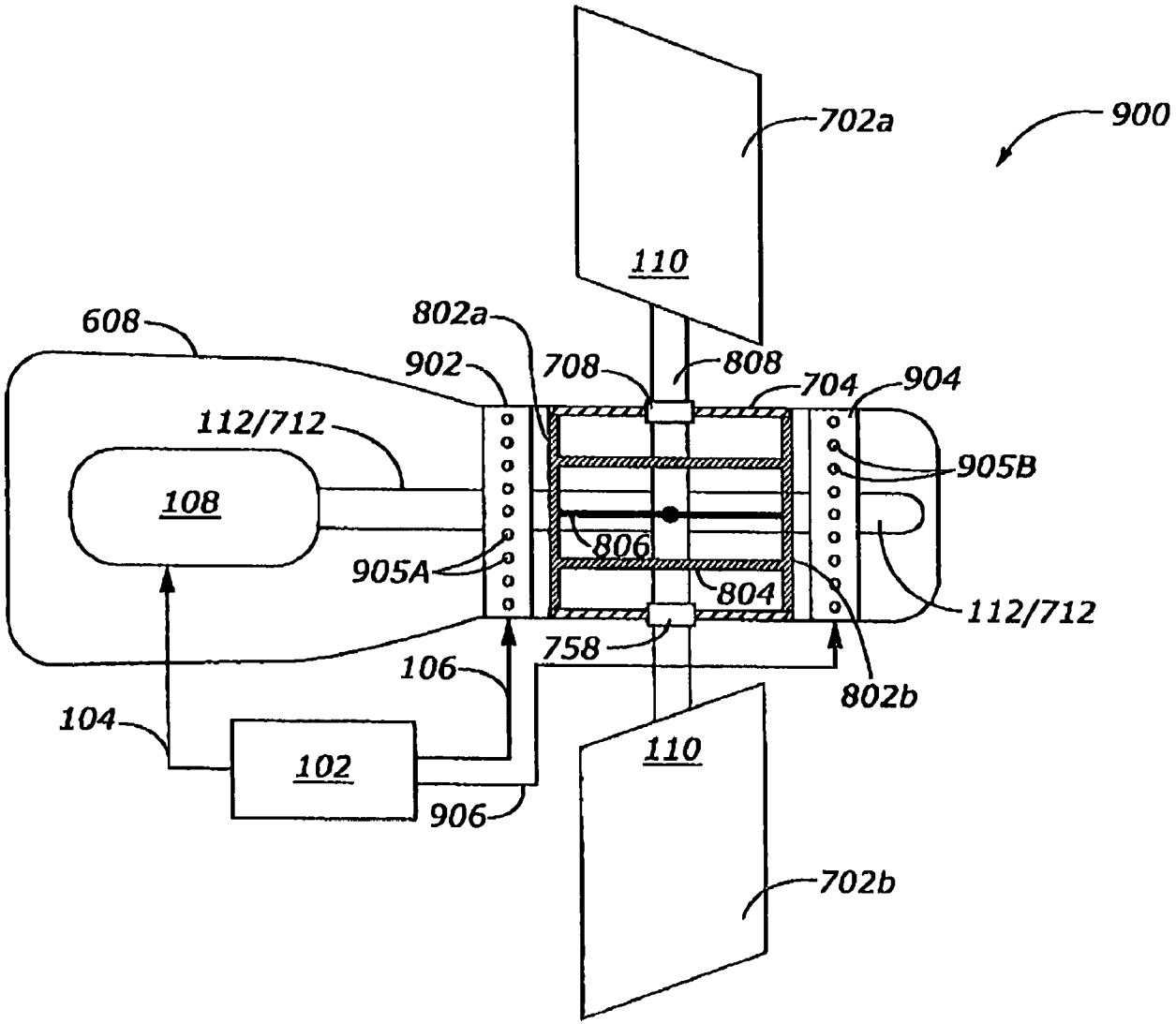
FIG. 9 is a block diagram of an exemplary integrated propulsion and guidance system.

With final reference now to FIG. 9, an exemplary integrated propulsion and guidance system 900 suitably includes an impeller 110 with one or more control blades 702*a*–*b* that provide variable blade pitch as described above. As described in FIG. 1, an engine 108 suitably provides rotational energy to a driveshaft 112/712 in response to control signal 104 provided by controller 102. Control motor 110 (FIG. 1) pivots blades 702*a*–*b* in response to control signal 106 produced by controller 102. In the exemplary embodiment shown in FIG. 9, control motor 110 suitably includes one or more electromagnets 902, 904, each having an electrical conductor 905 arranged in a coil or other appropriate pattern to generate magnetic fields. Control signal 106 is shown provided to electromagnet 902 to control the direction and magnitude of an electrical current flowing in conductor 905A. Similarly, a separate control signal 906 is shown provided to electromagnet 904 to control the direction and magnitude of an electrical current flowing in conductor 905B. The second electromagnet and associate control signals are optional, however, and may not be found in all embodiments. Further, the particular control signals 106 and 906 applied to electromagnets 902 and 904 may vary from embodiment to embodiment. The control signals may be modulated or encoded in any manner, for example, and may result in sinusoidal currents, pulses of currents, or any other electrical result in conductors 905A–B.

Electromagnets 902 and 904 produce appropriate magnetic fields to attract and/or repel magnets 802*a*–*b* and to thereby place blades 702*a*–*b* into a desired pitch state. Accordingly, electromagnet 902 typically attracts magnet 802*a* while electromagnet 904 repels magnet 802*b*, and vice versa. Control signals 106 and 906 are therefore typically opposite signals (e.g. sinusoids that are 180 degrees out of phase) that may be produced in any manner. In alternate embodiments, however, one of the electromagnets is eliminated, and actuation is carried out by a single electromagnet 902 interoperating with one or more magnets 802 coupled to blades 702. In still other alternate embodiments, multiple electromagnets are provided on each side of impeller 110. As magnets 802*a*–*b* move laterally with respect to hub 704 in response to the applied magnetic fields, arms 806 mechanically couple the movement to shaft 808, which pivots in bearings 708 to place blades 702*a*–*b* into the desired position. Electromagnets 902, 904 are typically placed within several inches or so of magnets 802 to improve magnetic coupling between the two, although the exact dimensions and distances of the various components may vary significantly from embodiment to embodiment. Because the actuating force is provided by an electromagnetic field, however, no mechanical linkage is required between control motor 110 and control blade 702. Magnetic actuation may also be used in vehicles having two or more impellers, as discussed above in conjunction with FIG. 1B.

While at least one exemplary embodiment has been presented in the foregoing detailed description, it should be appreciated that a vast number of variations exist. The concepts described herein with respect to watercraft, for example, are readily applied to aircraft and to other vehicles traveling through fluid media such as air or water. Similarly, the various mechanical structures described herein are provided for purposes of illustration only, and may vary widely in various practical embodiments. Accordingly, the various exemplary embodiments described herein are only examples, and are not intended to limit the scope, applicability, or configuration of the invention in any way. Rather, the foregoing detailed descrotion will provide those skilled in the art with a convenient road map for implementing the exemplary embodiment or exemplary embodiments. It should be understood that numerous changes can be made in the selection, function and arrangement of the various elements without departing from the scope of the invention as set forth in the appended claims and the legal equivalents thereof.

What is claimed is:

1. A vehicle having an integrated propulsion and guidance system, the vehicle comprising:

an engine configured to rotate a driveshaft;

an impeller coupled to the driveshaft to thereby propel the vehicle, wherein the impeller comprises a hub, a plurality of fixed blades, and at least one control blade coupled to a magnet and configured to rotate with respect to the hub;

a control system coupled to the impeller, wherein the control system is configured to provide a control signal; and a magnetic actuator configured to receive the control signal and to produce an electromagnetic field as a function of the control signal, wherein the magnetic field is operable to displace the magnet and to thereby pivot the at least one control blade with respect to the hub.

2. The vehicle of claim 1 wherein the magnetic actuator comprises an electromagnet having an electrical conductor.

3. The vehicle of claim 2 wherein the control signal corresponds to an electrical current provided to the electrical conductor.

4. The vehicle of claim 1 wherein the control signal comprises a sinusoidal waveform.

5. The vehicle of claim 1 wherein the control signal comprises a sawtooth waveform.

6. The vehicle of claim 1 wherein the magnet is a permanent magnet.

7. The vehicle of claim 1 wherein the control system is further configured to adjust the phase of the control signal to thereby adjust the phase of the blade pitch adjustment applied to the at least one control blade.

8. The vehicle of claim 7 wherein the control system is further configured to adjust the magnitude of the control signal to thereby adjust the magnitude of the blade pitch adjustment applied to the at least one control blade.

9. The vehicle of claim 1 further comprising a second impeller configured to rotate in an opposite direction from the impeller, wherein the second impeller comprises a second hub, a second plurality of fixed blades and at least one second control blade coupled to a second magnet and pivotable with respect to the second hub.

10. The vehicle of claim 9 further comprising a second magnetic actuator coupled to the second impeller wherein the magnetic field is operable to displace the second magnet and to thereby pivot the at least one second control blade with respect to the second hub.

11. The vehicle of claim 10 wherein the control system is further configured to provide a second control signal to the second magnetic actuator.

12. An impeller assembly configured to rotate on a driveshaft for a vehicle, the impeller comprising:

an impeller hub;

a plurality of fixed impeller blades rigidly coupled to the impeller hub, each of the fixed impeller blades having a common blade pitch; and a control blade assembly pivotably coupled to the impeller hub, wherein the control blade assembly comprises:

a pair of control blades joined by a shaft;

a magnet assembly coupled to the shaft; and a bearing assembly supporting the shaft within the impeller hub such that the shaft is configured to pivot in response to an electromagnetic field applied to the magnet assembly to thereby adjust the blade pitch of the control blades.

13. The impeller assembly of claim 12 wherein the magnet assembly comprises a first magnet coupled to the shaft by an arm.

14. The impeller assembly of claim 13 wherein the magnet assembly comprises a second magnet coupled to the first magnet by at least one journal bearing.

15. A variable pitch control blade assembly for an impeller having an impeller hub, the control blade assembly comprising:

a pair of control blades joined by a shaft;

a magnet assembly coupled to the shaft; and a bearing assembly configured to pivotably support the shaft within the impeller hub such that the shaft is configured to pivot in response to an electromagnetic field applied to the magnet assembly to thereby adjust the blade pitch of the control blades.

* * * * *